US005901778A

United States Patent [19]

Ichikawa et al.

[11] Patent Number: 5,901,778

[45] Date of Patent: May 11, 1999

[54] METHOD OF MANUFACTURING METALLIC MATERIALS WITH EXTREMELY FINE CRYSTAL GRAINS

[75] Inventors: Kiyoshi Ichikawa, Tsuchiura; Masahito Katoh, Tsukuba, both of Japan

[73] Assignee: Agency of Industrial Science & Technology, Ministry of International Trade & Industry, Tokyo, Japan

[21] Appl. No.: 08/827,449

[22] Filed: Mar. 28, 1997

[30] Foreign Application Priority Data

May 7, 1996 [JP] Japan ..... 8-137674

[51] Int. Cl.[6] ..... B22D 27/08

[52] U.S. Cl. ..... 164/480; 164/113; 164/900

[58] Field of Search ..... 164/900, 71.1, 164/480, 428, 113

[56] References Cited

U.S. PATENT DOCUMENTS 3,902,544 9/1975 Flemings et al. .
3,936,298 2/1976 Mehrabian et al. .
3,948,650 4/1976 Flemings et al. .
3,951,651 4/1976 Mehrabian et al. .
3,954,455 5/1976 Flemings et al. .
4,636,355 1/1987 Ichikawa .
4,865,808 9/1989 Ichikawa et al. .
4,917,359 4/1990 Ichikawa et al. .
5,358,687 10/1994 Ichikawa et al. .

*Primary Examiner*—Kuang Y. Lin
*Attorney, Agent, or Firm*—Oblon, Spivak, McClelland, Maier & Neustadt, P.C.

[57] ABSTRACT

A method of manufacturing metallic materials with extremely fine crystal grains comprises the steps of: taking molten metallic material that was melted by heating in a melting chamber and introducing it into an agitation chamber from said melting chamber, and in this agitation chamber, agitating it for 60 seconds or less by means of a screw-shaped stirring rod that is driven to rotate at 500 rpm or greater, and extruding the metallic material in the state of solid-liquid coexistence from an extrusion nozzle on the outlet side, and quench-solidifying the metallic material in the state of solid-liquid coexistence extruded from said nozzle immediately while it still has fine crystal grains as it is continuously formed into the desired shape. In this method, the speed of rotation of the screw-shaped stirring rod may be 800 to 1000 rpm. Also, the time in which the metallic material resides in the state of solid-liquid coexistence may be 5 to 60 seconds.

6 Claims, 2 Drawing Sheets

METHOD OF MANUFACTURING METALLIC MATERIALS WITH EXTREMELY FINE CRYSTAL GRAINS

BACKGROUND OF THE INVENTION

1. Field of the Invention

This invention relates to a method of manufacturing metallic materials with extremely fine crystal grains.

2. Description of the Prior Art

Although advances have been made in the development of metallic materials through heat treatment, plastic forming and the addition of alloy elements in order to control the microstructure of crystal grains 1 $\mu$m or larger, the control of the mesoscopic structure, on the scale of 1 $\mu$m or smaller, has stimulated the fields of semiconductor materials and chemical materials, and various research organizations have studied the methodology for control of mesoscopic structure and have obtained fundamental knowledge regarding materials design techniques. As a further extension of this, by developing basic technologies that can extend control of the mesoscopic structure of metallic materials to its limits, it would be possible to reduce our dependence on limited resources of alloy elements as much as possible, improve recyclability, and also dramatically improve the functionality of metallic materials as well as their strength and various other characteristics.

To explain this more specifically, one of the representative characteristics of a metallic material, the strength, is known to increase as the crystal grain size becomes finer according to the Hall-Petch relationship. In addition, characteristics (corrosion resistance, magnetism, etc.) that are made manifest by differences in the mesoscopic or nanocrystalline structure are also known to be different. On the other hand, current technologies for improving the performance of current metallic materials (addition of alloy elements, plastic forming, heat treatment, etc.) are approaching the limits to the degree by which the characteristics can be improved. Moreover, with current technologies it is difficult to obtain metallic materials with crystal grain sizes smaller than 1 $\mu$m, and for this reason, the improvement of characteristics is heavily dependent on alloying or the use of composite materials, resulting in a loss of recyclability depending on the alloy composition of the metallic material, and moreover, the degree of dependence on limited resources of alloying elements increases.

To this end, by breaking down the crystal grain size 1 $\mu$-m barrier or nearing this barrier, through the approach of increasing the fineness of the structure in the Hall-Petch region and improving characteristics (by mesoscopic structure control), we expect to establish fundamental technologies for materials development that are able to extend the strength, functionality and other aspects of the performance of the material to their ultimate limits, and thus control the structure of metallic materials up to their ultimate limits. Moreover, by developing such fundamental technologies, if the mesoscopic structure can be controlled on an extremely fine scale, not only can the strength, functionality and other characteristics of metallic materials be dramatically increased to near their theoretically predicted limits, but also we will be able to greatly reduce our dependence on the limited resources of alloy elements, and develop alternatives to and conserve rare resources (nickel, chrome, cobalt, copper, tin, zinc and other metals), and moreover, we can improve recyclability of metallic materials.

The fundamental object of the present invention is to implement mesoscopic structure control in order to improve the characteristics of materials by making the crystal grain size finer in accordance with the Hall-Petch relationship, as one technique for pursuing a process for making the crystal grain size finer that differs from the conventional technology.

In consideration of the demands that will be placed on future metallic materials with regard to improved durability, reliability, safety and the like, to be achieved through improvements in strength and functionality, a more specific object of the present invention is to provide a method for manufacturing metallic materials with extremely fine crystal grains in which mesoscopic structure control can be implemented by simple means in order to improve the characteristics of materials by making the grain size finer.

SUMMARY OF THE INVENTION

For achieving this object, the method of manufacturing metallic materials with extremely fine crystal grains of the present invention comprises the steps of:

taking molten metallic material that was melted by heating in a melting chamber and introducing it into an agitation chamber from said melting chamber, and in this agitation chamber, agitating it for a short period by means of a screw-shaped stirring rod that is driven to rotate at high speed, and extruding the metallic material in the state of solid-liquid coexistence from an extrusion nozzle on the outlet side, and quench-solidifying the metallic material in the state of solid-liquid coexistence extruded from said nozzle immediately while it still has fine crystal grains as it is continuously formed into the desired shape.

In this method of manufacturing metallic materials with extremely fine crystal grains, having the screw-shaped stirring rod in the agitation chamber rotate at a speed of at least 500 rpm or greater, and making the amount of time that the metallic material in the state of solid-liquid coexistence resides within the agitation chamber 60 seconds or less is effective in achieving a fine crystal grain size by agitation during solidification.

By means of the method of the present invention, the molten metallic material that was melted by heating in a melting chamber and introduced into an agitation chamber is agitated within the agitation chamber by a stirring rod that is driven to rotate at a very high speed, in contrast to ordinary injection molding (where the speed of rotation is 100 rpm or less in the injection molding of metal). The agitation is performed very intensely over a short period in contrast to the aforementioned ordinary injection molding, and the crystal grains that form are disintegrated and grain growth is suppressed, so a large number of extremely fine grains is present in the material that is extruded from the extrusion nozzle while still in the state of solid-liquid coexistence. The material is immediately quench-solidified in that state as it is continuously formed into the desired shape, and thereby, as will be evident from the preferred embodiments to be described later, a metallic material with extremely fine crystal grains can be manufactured easily.

In consideration of the demands that will be placed on future metallic materials with regard to improved durability, reliability, safety and the like, to be achieved through improvements in strength and functionality, this method permits the implementation of mesoscopic structure control that improves the characteristics of materials through finer crystal grains, through a simple means that makes use of agitation during solidification.

The above and other objects and features of the present invention will become apparent from the following description made with reference to the drawings.

DESCRIPTION OF THE PREFERRED EMBODIMENTS

The inventors tried various techniques of achieving the improvement in materials characteristics and performance through a fine crystal grain size, but the intense agitation over a short period by means of a stirring rod rotating at high speed, to be described later, was found to be effective in achieving a fine crystal grain size.

The present invention is based on this knowledge, and fundamentally it involves: taking molten metallic material that was melted by heating in a melting chamber and introducing it into an agitation chamber from the melting chamber, and in this agitation chamber, agitating it for a short period of 60 seconds or less by means of a screw-shaped stirring rod that is driven to rotate at a high speed of 500 rpm or greater, and extruding the metallic material in the state of solid-liquid coexistence from an extrusion nozzle on the outlet side, and quench-solidifying the metallic material in the state of solid-liquid coexistence extruded from said nozzle immediately while it still has fine crystal grains as it is formed by rolling into a continuous sheet, bar or other desired shape.

The speed of rotation of the screw-shaped stirring rod within said agitation chamber should preferably be 800 rpm or greater in order to make the molten metallic material smoothly into spray-like droplets. In addition, making the time that the metallic material resides in the agitation chamber in the state of solid-liquid coexistence to be roughly 5–60 seconds is effective in achieving a fine crystal grain size.

Figure 1:
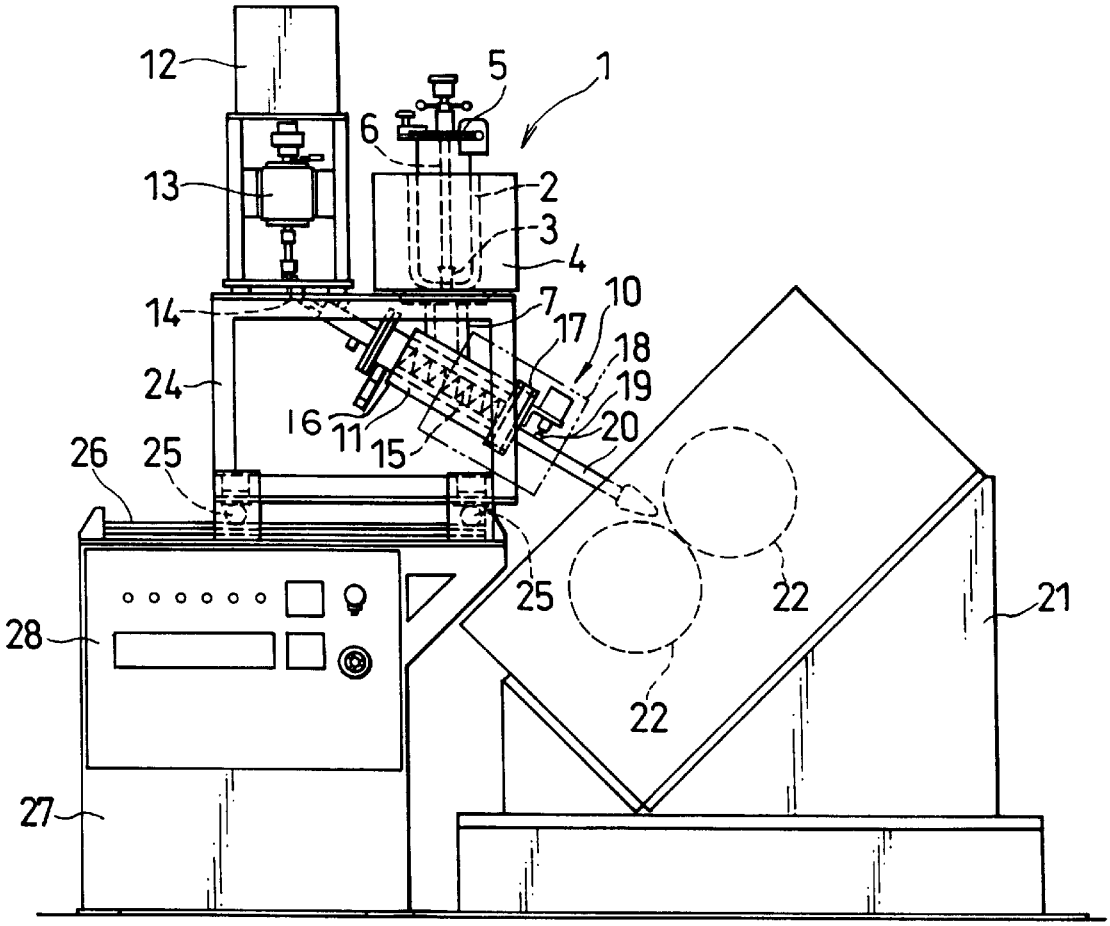
FIG. 1 is a front view of one example of the apparatus in which the method of manufacturing metallic materials with extremely fine crystal grains of the present invention is performed.

FIG. 1 shows one preferred embodiment of an apparatus for the manufacture of sheets of high-performance metallic materials with extremely fine crystal grains based on the method of the present invention.

In this apparatus, the melting apparatus 1 is vertical cylindrical in shape, consisting of a cylindrical crucible 2 made of graphite which forms the melting chamber for the metallic material with a closing plug 3 provided in the bottom and an outside-heating furnace 4 with a heater provided around its perimeter. The opening and closing cover 5 of this melting apparatus 1 is controlled by a opening and closing control apparatus (not shown), and holds the opening and closing shaft 6 of the closing plug 3 which opens and closes the closing plug 3 at the stipulated temperatures. Moreover, the melting chamber within the crucible 2 is connected to a gas supply line (not shown) for maintaining an inert gas atmosphere of argon or the like inside the melting chamber.

Note that it is possible that metallic material can be continuously supplied to the melting chamber, and if the air tightness of the melting apparatus 1 and the agitating apparatus 10 in the next stage can be maintained, then the interior of the chamber can be held at a vacuum without supplying inert gas to the melting chamber.

Moreover, connected to the bottom edge of the discharge line 7 made of graphite through which the molten metallic material is discharged through the closing plug 3 is a cylinder 11 which forms the agitating apparatus 10. This cylinder 11 has a stainless steel (AISI 304) outer sheath, within which is provided an inner sheath made of graphite within which is formed the agitation chamber. The outlet side of the cylinder 11 is slanted downward at an oblique angle, and inside the inner sleeve of the cylinder 11 is provided a stirring rod 15 with a graphite screw-type stirring element in such manner that it is free to rotate so that it can be driven to rotate by a motor 12 via a torque detector 13 and universal joint 14. This motor 12 drives the screw-type stirring rod 15 in the direction that the molten metallic material is pushed out the discharge side.

The periphery of this cylinder 11 is covered with insulation 16 and also the discharge flange 17 provided on the discharge side portion and discharge side end is enveloped by an isothermal heating apparatus 18, and attached to this discharge flange 17 is an extrusion nozzle 20 provided with a closure stopper 19. Moreover, at the extrusion tip of this extrusion nozzle 20 is provided a rotary caster, namely a stand 21 holding a pair of rollers 22 that continuously roll the metallic material that is being extruded in the state of solid-liquid coexistence into a thin sheet. By passing cooling water through the interior of this pair of rollers 22, the metallic material extruded from the nozzle 20 can be quenched.

The aforementioned melting apparatus 1 and agitating apparatus 10 are mounted in a frame 24 and this frame 24 is provided with wheels 25 which ride upon rails 26 on top of a table 27 provided with a control panel 28 for controlling the driving of the various parts, and the frame 24 runs along the rails 26 such that the movement of the nozzle 20 can be adjusted in the direction towards or away from the rollers 22.

The aforementioned outside-heating furnace 4 is provided with a temperature detector (not shown) that detects the heating temperature so that when the metallic material melted by heating in the melting chamber within the crucible 2 reaches the stipulated temperature, the opening and closing shaft 6 of the closing plug 3 is driven to open the closing plug 3, and the melt flows down into the agitation chamber. In addition, a temperature detector (not shown) is also provided within the closing plug 3 in order to detect directly the temperature of the molten metal material itself within the melting chamber. Moreover, the cylinder 11 that makes up the agitating solidification apparatus is also provided with a temperature detector (not shown) in order to detect the temperature of the metallic material in the state of solid-liquid coexistence inside the cylinder 11. These temperature detectors are all connected to the control panel 28, and are used for appropriate control of the manufacture of metallic material with fine crystal grains.

Note that the aforementioned rollers 22 can be replaced by opposing dies or the like that can continuously form wire from the extruded metallic material in the state of solid-liquid coexistence.

In addition, while the apparatus described above indicates the case of batch processing, the supply of metallic material to the melting chamber of the melting apparatus 1 can be performed continuously, and it can be made to flow down at a constant temperature by means of agitation or the like, to give a continuous processing configuration.

In the manufacture of metallic material with fine crystal grains in the apparatus described above, the metallic material serving as the raw material is melted by heating in the melting chamber within the crucible 2 and is introduced at a constant temperature into the agitation chamber within the cylinder 11 in which the stirring rod 15 is driven to rotate at a high speed of 800 rpm to 1,000 rpm. In the agitation chamber, the molten metallic material introduced in the semi-solid state is agitated intensely by the stirring rod 15 for a short period no longer than 60 seconds and extruded from the extrusion nozzle 20 as a semi-solid slurry while still in the state of solid-liquid coexistence. The semi-solid slurry having uniformly fine crystal grains is immediately quench-solidified as it is rolled into a continuous sheet between the pair of rollers 22 in the rotary caster, and thus, as will be evident from the preferred embodiments to be described later, a metallic material with extremely fine crystal grains can be manufactured easily.

Next, we present a comparison of the conventional agitation-solidification method (rheocasting) and the high-speed batch agitation-solidification method proposed previously by the inventors, their characteristics and also a comparison of the performance of the materials manufactured thereby.

Both of these methods are based on agitation during solidification but rheocasting involves much agitation in the state of solid-liquid coexistence or much agitation of the bulk alloy materials during gradual cooling and solidification in the continuous cooling process, in order to obtain a more uniform macrostructure, but the agitation time is long (on the order of 10 minutes), so large amounts of impurity elements are enriched in the primary crystals formed during that agitation time due to active diffusion within the primary crystals, so high-quality materials cannot be reproduced by the rheorefining (semi-molten refining) method, and the crystal grain size also becomes large. With the agitation-solidification method previously proposed by the inventors, the agitation speed and cooling speed were speeded up, but the agitation time is relatively long (roughly several minutes) so that the bulk semi-solid metals and alloys are adequately agitated, and thus diffusion proceeds within the primary crystals and a impurity-enriched primary crystal occurs in the same manner, although not to the same degree as in the conventional rheocasting method.

In contrast, in the method of the present invention, the molten metal is agitated by a screw-shaped stirring rod as it passes through the agitation chamber extremely quickly, so the agitation time is extremely short (only less than one minute), so large numbers of fine crystal grains are formed simultaneously and most of those grains do not become enlarged but rather it is sent out in the state in which crystal multiplication is promoted accompanying the formation of new nuclei, so without active diffusion occurring within the primary crystal, the semi-solid slurry sent out between a pair of rollers 22 is pressurized and compressed, and solidification occurs in the state in which the crystal grains have propagated markedly without becoming larger, thus achieving a new type of agitation-solidification with remarkable big bang nucleation. As a result, the impurity elements are concentrated at the grain boundaries, so the reproduction of high-quality materials comparable to new materials can be achieved very efficiently by the rheorefining.

In addition, while crystal grain sizes on the order of 100 $\mu$m are typical for the rheocasting method described above, those of the agitation-solidification method previously proposed by the present inventors had been 50 $\mu$m or greater, with the method of the present invention, the crystal grains are much finer, reaching 10 $\mu$m or less.

In order to achieve the method of the present invention described above, the temperature of the test alloy in the agitation chamber must be near the upper end (liquidus) of the temperature range in which solid and liquid forms of the same alloy coexist (solidification period), or in other words, the temperature must be set to that of the initial stage of solidification. To this end, the temperature to which the agitation chamber is heated must be set to a temperature range roughly 100° C. higher than the temperature of the start of equilibrium solidification (liquidus temperature) of the test alloy. The reason for this is that the shaft of the screw that performs the agitation is cooled, so the test alloy is cooled by the screw and heated by the inside wall of the vessel.

In addition, by keeping the temperature of the melt uniform, it is easier for large numbers of fine crystal grains to be formed.

Therefore, the "conditions for extremely fine crystal grains to be formed" are as follows:

(a) The temperature of the test alloy in the agitation chamber must be in a temperature range in which the solid and liquid phases of the same alloy coexist in the equilibrium state diagram, and the range of the fraction of solid of 1 to 50% is thought to be appropriate.

(b) The test molten alloy is to be put into the supercooled state at a constant temperature within the temperature range described in (a), and in order to cause large numbers of primary crystals to form simultaneously as soon as that temperature is reached, the temperature of the molten alloy in the fluid state must be made as uniform as possible. Agitation with a screw is effective in making this temperature uniform.

(c) In order to obtain the conditions of (b), when the molten alloy to be tested is introduced from the melting chamber into the agitation chamber, the cooling rate is increased because it is turned into spray-like droplets from contact with the rapidly rotating screw.

(d) Under the same cooling conditions as (c), the multiplication of uniformly fine crystal grains is possible.

Here follows one embodiment of the present invention.

The apparatus used in testing essentially has the structure shown in FIG. 1 described above. The performance of the apparatus is described as follows. The heating temperature is normally 800° C. and a maximum of 1000° C. in the melting chamber, and a maximum of 750° C. in the agitation chamber. The speed of revolution of the stirring rod 15 is 1000 rpm empty. The interior volume of the melting chamber is approximately 115 mmϕ×350 $mm^H$ and the interior volume of the agitation chamber is approximately 90 mmϕ× 350 $mm^L$. In addition, the two rollers 22 used in the rotary caster were buff-finished to 30 $\mu$m and chrome-plated, the interior of the roller is water cooled, the dimensions of the rollers are 300 mm in diameter with an effective width of 40 mm, and the gap between rollers can be adjusted from 0 to 10 mm. The roller speed is a maximum of 22 rpm, the torque is a maximum of 900 kg·m and the motor 12 is a 22 kW inverter-drive motor.

The experimental procedure starts by taking 99.999% pure aluminum particles and 99.99% pure copper in the form of sheets approximately 10 mm square and combining them to achieve the desired Al-10% Cu alloy, placing a total weight of 500 g in the melting chamber, and heating the sample in this melting chamber while refluxing with argon gas. At this time, the maximum heating temperature of the outside-heating furnace 4 is set to 912° C. and the temperature of the alloy sample within the agitation chamber detected at the closing plug 3 is set to 750° C.

After the sample is melted in the melting chamber, the sample is held in that state for 30 minutes to make the temperature of the molten alloy uniform at 801° C. Thereafter, the closing plug 3 in the bottom of the crucible 2 which forms the melting chamber is opened and the molten alloy is allowed to flow into the agitation chamber in which the stirring rod 15 is already rotating at a speed of 1000 rpm. Five seconds after the molten alloy flows into the agitation chamber, the closure stopper 19 which had blocked the discharge side of the agitation chamber is opened, so the well-agitated semi-solidified alloy slurry is disgorged between the pair of rollers 22, and a high-performance sheet is formed directly between the rotating rollers 22. The speed of rotation of the rollers was 11 rpm, and the rate of manufacture of sheet was 17 cm/sec.

Figure 2:
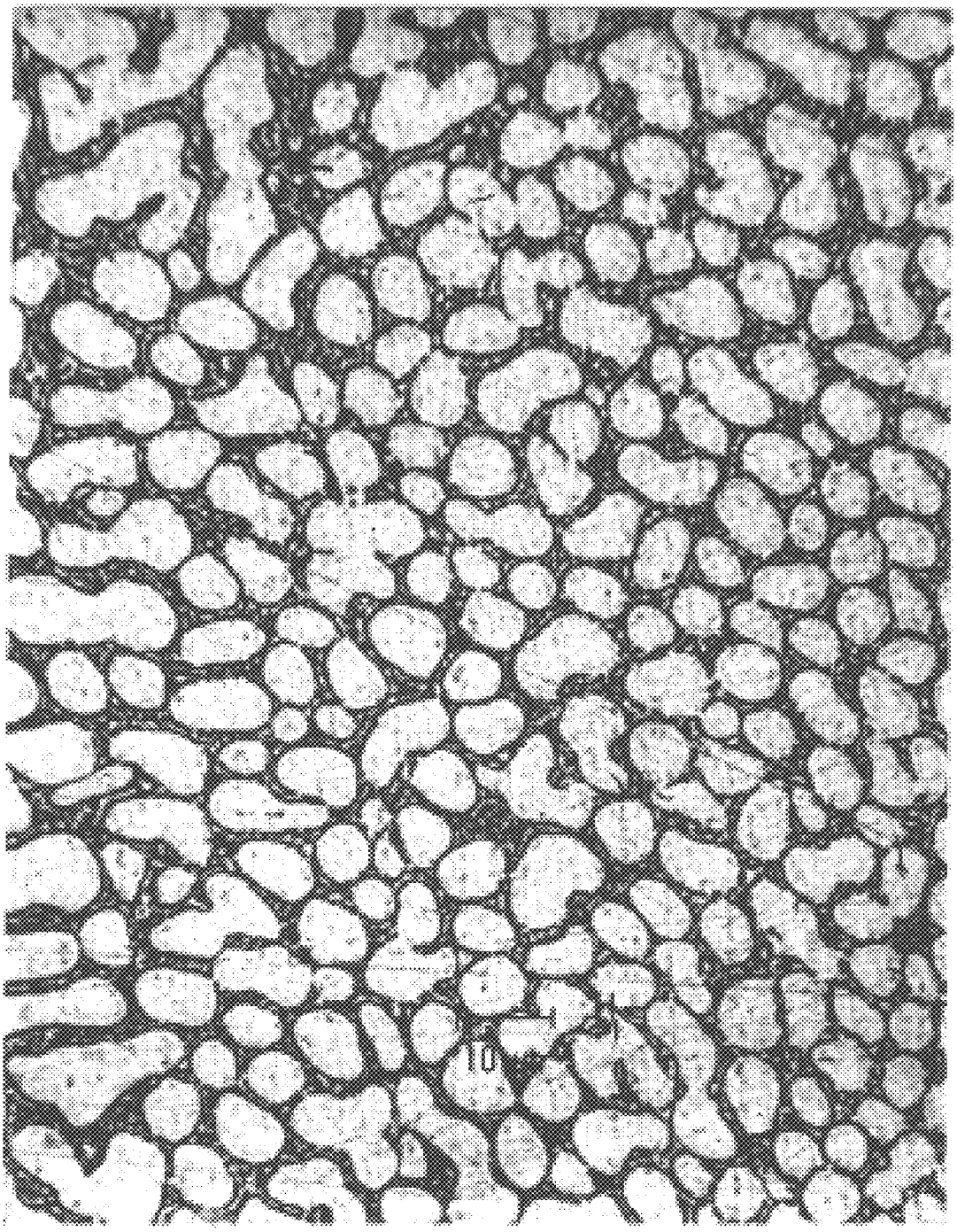
FIG. 2 is a microphotograph showing the structure of the metallic material obtained based on the method of the present invention.

This experiment in the manufacture of sheet was successful in manufacturing lustrous sheet. We observed the microstructure of the sheets of Al-10% Cu alloy thus agitated during solidification, and FIG. 2 shows the structure when photographed at 1000× magnification.

One observes an extremely fine-grained structure of primary crystal grains (the white grain-shape portions) with a grain size of 10 $\mu$m or smaller that were formed simultaneously. Note that the tiny white portions in the eutectic crystals present between the grains are Al and the black portions are $CuAl_2$. This large fraction of eutectic indicates that the large numbers of fine primary crystal grains formed simultaneously did not become coarse.

In addition, we cut five test pieces from the Al-10% Cu alloy sheet which had a microstructure with a grain size of 10 $\mu$m or less and performed tensile tests twice at room temperature and three times at 500° C., giving the results shown in Table 1. For comparison, a molten alloy sample of the same composition was solidified in the melting chamber without performing the agitation process in the agitation chamber, and when the thin plate of alloy thus obtained was heated to 500° C. and its tensile strength was measured, the elongation was 180% or less.

According to these results, since a large elongation was obtained at 500° C., by means of the method of the present invention, the simple method of agitation-solidification was used to obtain a metallic material that had the property of superplasticity.

TABLE 1

| Test temperature | Tensile strength (MPa) | Elongation (%) |
|---|---|---|
| Room temperature | 248 | 11 |
| Room temperature | 229 | 12 |
| 500° C. | 8.6 | 221 |
| 500° C. | 6.9 | 234 |
| 500° C. | 6.6 | 236 |

By means of the method of manufacturing metallic materials with extremely fine crystal grain sizes based on continuous agitation during solidification according to this invention described in detail above, in consideration that of the demands that will be placed on future metallic materials with regard to improved durability, reliability, safety and the like, to be achieved through improvements in strength and functionality, one can obtain a method of manufacturing metallic materials with extremely fine crystal grain sizes that permits the implementation of mesoscopic structure control that improves the characteristics of materials through finer crystal grains, through a simple means. In particular, as verified by the present inventors, the use of an agitation-solidification method based on the knowledge that rapid agitation and extrusion by means of a rapidly rotating screw-shaped stirring rod is effective in forming fine crystal grains is extremely effective in the manufacture of metallic materials with extremely fine grains by a simple method.

In addition, since steel, aluminum and other relatively abundant representative metallic materials can be made to achieve high performance and high functionality with only that material alone, without depending on alloying or the like, this invention can make an extremely important contribution in applications in various fields such as improving the fuel efficiency and reducing the emissions of vehicles, in applications in the structural material and decorative material for skyscrapers, in structural members for large bridges, and moreover in space planes, supersonic and hypersonic transport aircraft and other applications in structural materials that operate under severe environments.

What is claimed is:

1. A method of manufacturing metallic materials with extremely fine crystal grains comprising the steps of:

providing molten metallic material in a melting chamber;

introducing the molten metallic material into an agitation chamber from the melting chamber to form a semi-solid, the agitation chamber having an inside wall and a screw-shaped stirring rod rotating at 500 rpm or higher, the inside wall having a temperature about 100° C. higher than a liquidus temperature of the molten metallic material and the screw-shaped stirring rod having a temperature below a temperature of the semi-solid;

agitating the semi-solid for 60 seconds or less by means of the screw-shaped stirring rod;

extruding the semi-solid from an extrusion nozzle; and quench-solidifying the semi-solid to form a quenched solid.

2. The manufacturing method according to claim 1, wherein the screw-shaped stirring rod rotates at 800 to 1000 rpm.

3. The manufacturing method according to claim 1, wherein the semi-solid is agitated for 5 to 60 seconds.

4. The method according to claim 1, wherein the semi-solid comprises a volume fraction of solid in a range from 1 to 50%.

5. The method according to claim 1, wherein the agitation of the semi-solid forms spray droplets.

6. The method according to claim 1, wherein the quenched solid comprises crystal grains having a diameter of 10 $\mu$m or less.

* * * * *